US005154526A

United States Patent [19]

Bothe

[11] Patent Number: 5,154,526

[45] Date of Patent: Oct. 13, 1992

[54] CAPILLARY PEN COVER

[75] Inventor: Thomas Bothe, Nürnberg, Fed. Rep. of Germany

[73] Assignee: J. S. Staedtler GmbH & Co., Nuremberg, Fed. Rep. of Germany

[21] Appl. No.: 812,911

[22] Filed: Dec. 20, 1991

[51] Int. Cl.[5] ..... B43K 9/00

[52] U.S. Cl. ..... 401/258; 401/202; 401/213; 401/243; 401/247

[58] Field of Search ..... 401/243, 247, 258, 259, 401/260, 213, 202, 107, 108

[56] References Cited

U.S. PATENT DOCUMENTS

| | | | |
|---|---|---|---|
| 4,086,011 | 4/1978 | Kuparinen | 401/258 |
| 4,548,325 | 10/1985 | Hojer et al. | 401/258 X |
| 4,595,308 | 6/1986 | Schiefnetter et al. | 401/247 X |

FOREIGN PATENT DOCUMENTS

| | | | |
|---|---|---|---|
| 2443836 | 4/1976 | Fed. Rep. of Germany | 401/258 |
| 2108893 | 5/1972 | France | 401/258 |

*Primary Examiner*—Steven A. Bratlie
*Attorney, Agent, or Firm*—Kenyon & Kenyon

[57] ABSTRACT

Protective cap for capillary writing instruments comprised of a relatively flexible outer casing and a relatively rigid inner casing. One end of the outer casing is adapted to form a substantially fluid tight seal on the body of a writing instrument. A flexible sealing means, e.g., spherical, is positioned between the inner sheath and the outer sheath so as to form a substantially fluid tight seal on the tip of a writing instrument inserted into the inner casing and placed in contact with the sealing means. In another embodiment the sealing means located between the outer casing and inner casing is eliminated and the outer casing forms a substantially fluid tight seal by directly contacting the writing instrument tip.

4 Claims, 3 Drawing Sheets

CAPILLARY PEN COVER

FIELD OF THE INVENTION

The invention relates to protective caps for writing instruments and more specifically to protective caps for capillary writing instruments.

BACKGROUND OF THE INVENTION

Conventional capillary writers are usually comprised of a tubular sheath or body, an ink reservoir, and a capillary channel which extends to a tubular writing element. In contrast to caps for conventional writing instruments such as pencils, ball point pens, and fountain pens, which require seals which seal only the general area of the writing instrument from which the tip protrudes, capillary writing instrument caps, in addition to performing that sealing function, must also perform a second sealing function of sealing the tubular element or tip to prevent loss of ink or drying of ink. In order to achieve this dual sealing effect, the tip of the writing instrument must be pushed against the tip sealing material with adequate pressure for the tip sealing material to elastically deform. The tip then rests tightly against the tip sealing material resulting in the necessary sealing effect. In known caps for capillary writers the pressure applied by the tip to the tip sealing material frequently results in penetration of the tip into the tip sealing material. This often results in damage to the tip sealing material which impairs or destroys the sealing effect.

In the case of tubular pens having extremely fine points or tips, e.g., diameters of about 0.1 mm, the tubular writing elements are very thin and can be bent easily by the pressure which results from pressing the tubular writing element against the tip sealing material.

Caps or covers for capillary type writing instruments are well known. German patent 1915566 A1, European Patent 0 432 633 A1, German Patent DE 3702785 A1, German Patent 27 56 505, U.S. Pat. No. 4,086,011, Japanese Patent 1-20149, Japanese Patent 61-11016, German Patent 28 49 939, Japanese Patent 1-8391, and Japanese Patent 54-29850 disclose covers for capillary marking pens.

Other disadvantages of known capillary writing instrument caps is that they are complex and expensive to manufacture, leaks can occur at the air compensation seal because of the hardness of the materials (often greater than 70 Shore D) employed at this seal, and often a separate spring means may be necessary to bring the soft tip sealing material into contact with the tubular writing element.

OBJECTS AND SUMMARY OF THE INVENTION

It is an object of this invention to provide a cap for capillary writing instruments that is simple in construction, minimizes the risk of leaks at the air compensation seal, minimizes the risk of leaks at the writing tip seal, minimizes the risk that the tip sealing material will be punctured by the tip, and minimizes the risk that the tip will be damaged by contact with the tip sealing material.

The present invention provides a cap for a writing instrument, comprising: (a) a resilient outer casing provided with a longitudinal aperture, a closed end, and an open end, said closed end adapted to receive a sealing means, said open end adapted to form a substantially fluid tight seal around the body of a writing instrument; (b) an inner casing inserted into said longitudinal aperture of said outer casing, said inner casing having a longitudinal aperture, an open first end, and an open second end, said second end adapted to retain a sealing means between said second end of said inner casing and said closed end of said outer casing; (c) a resilient sealing means for forming a substantially fluid tight seal on a writing instrument tip, said sealing means located between said tubular inner casing and said resilient tubular outer casing; and (d) a securing means attached to the inner wall of said tubular inner casing securing the cap to the writing instrument.

The present invention also provides a cap for a writing instrument comprising; (a) resilient outer casing provided with a longitudinal aperture, a closed end, and an open end, said open end adapted to form a substantially fluid tight seal around the body of a writing instrument, said closed end adapted to form a substantially fluid tight seal on a writing instrument tip; (b) an inner casing provided with a longitudinal aperture and an open first end and an open second end, said inner casing inserted into the longitudinal aperture of said resilient tubular outer casing, said longitudinal aperture of said inner casing in communication with said sealing means; (c) a securing means attached to the inner wall of said inner casing for securing the cap to the writing instrument.

DETAILED DESCRIPTION OF THE INVENTION

Figure 4:
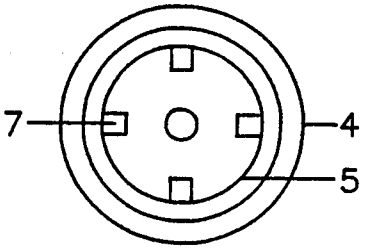
FIG. 4 is an end view of the open end of cap constructed in accordance with the invention.
Figure 3:
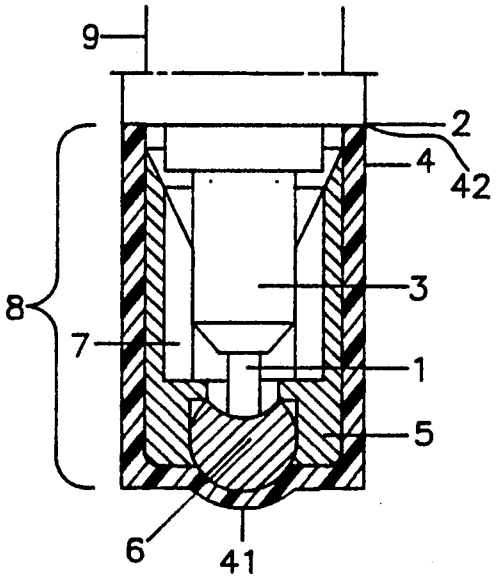
FIG. 3 is a sectional side view of a cap constructed in accordance with the invention and shows a completely inserted writing instrument.
Figure 2:
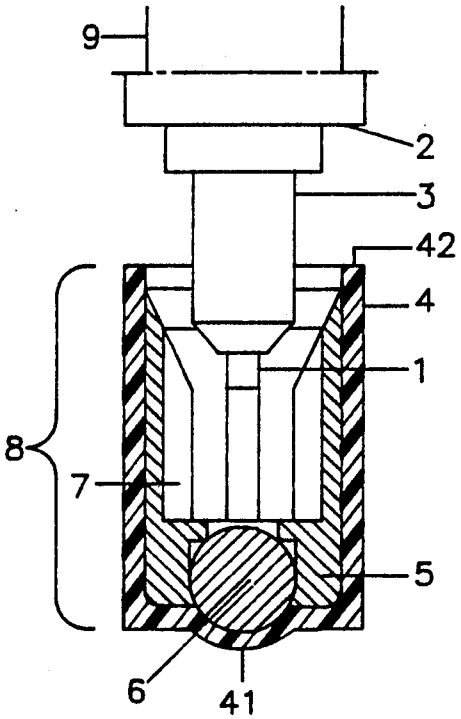
FIG. 2 is a sectional side view of a cap constructed in accordance with the invention and shows a partially inserted writing instrument.
Figure 1:
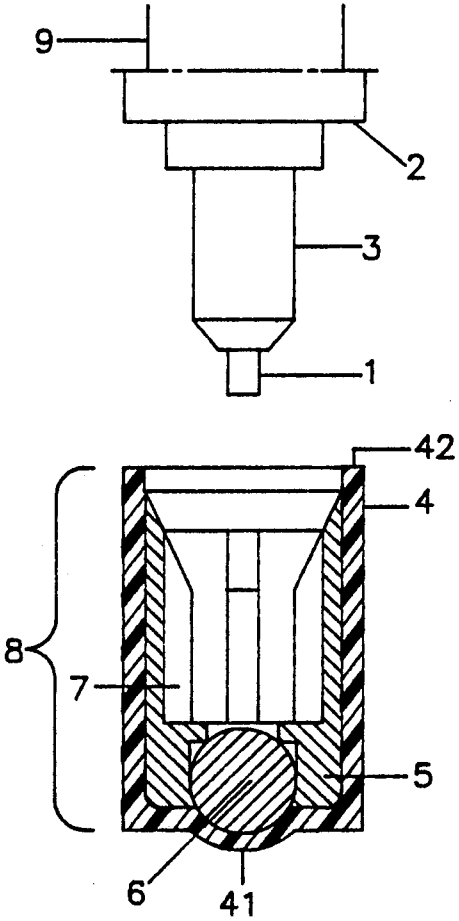
FIG. 1 is a sectional side view of a cap constructed in accordance with the invention and a side view of a writing instrument.

FIG. 1 shows writing instrument 9, pen tip 1, air compensation sealing surface 2, capillary sleeve 3, cap 8, resilient outer casing 4, inner casing 5, resilient sealing means 6, outer casing closed end 41, outer casing leading edge 42, and securing means 7. The inner casing 5 is firmly attached to the resilient outer casing 4 and may be glued, forced in, undercut, or may be attached to the outer casing 4 utilizing injection technology. The securing means 7 is adapted to grip the capillary sleeve 3 of the writing instrument 9, thus, securing the cap 8 on writing instrument 9. The resilient outer casing 4 is comprised of a highly elastic material (Shore A 37-60) which allows it to make a substantially fluid tight seal when it is pressed against air compensation sealing surface 2. The highly elastic material of resilient outer casing 4 also provides a good gripping surface for the fingers to facilitate removal of the cap 8. The inner casing 5 is comprised of material having a hardness greater than about 70 Shore B and is adapted to apply pressure against capillary sleeve 3 via securing means 7, thus, securing cap 8 on writing instrument 9. The closed end of resilient outer casing 4 is adapted to receive resilient sealing means 6. The resilient sealing means 6 may be of any shape, however, in a preferred embodiment the resilient sealing means 6 is spherical. Inner casing 5 is adapted at one end to secure resilient sealing means 6 between inner casing 5 and resilient outer casing 4. Resilient sealing means 6 is comprised of a flexible material suitable for forming a substantially fluid tight seal on writing instrument tip 1. When pen tip 1 comes into contact with resilient sealing means 6, resilient sealing means 6 deforms so as to prevent damage to tip 1 while forming a substantially fluid tight seal on tip 1. FIG. 2 shows the writing instrument 9 partially inserted into cap 8. FIG. 3 shows writing instrument 9 completely inserted into cap 8. Securing means 7 is in frictional communication with capillary sleeve 3 and tip 1 is in contact with resilient sealing means 6. The axial compliance of the sealing means 6 results from its own elasticity and/or as the result of the elasticity or the resiliency of the closed end 41 of the resilient outer casing 4. The compensation sealing surface 2 of the writing instrument 9 is substantially sealed by the leading edge 42 of the outer housing 4. Resilient sealing means 6 provides a substantially fluid seal on tip 1 without damaging or deforming tip 1. FIG. 4 is a top view of cap 8 showing outer casing 4, inner casing 5, and securing means 7.

Figure 8:
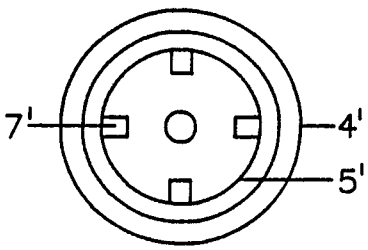
FIG. 8 is an end view of the open end of a cap constructed in accordance with the invention.
Figure 7:
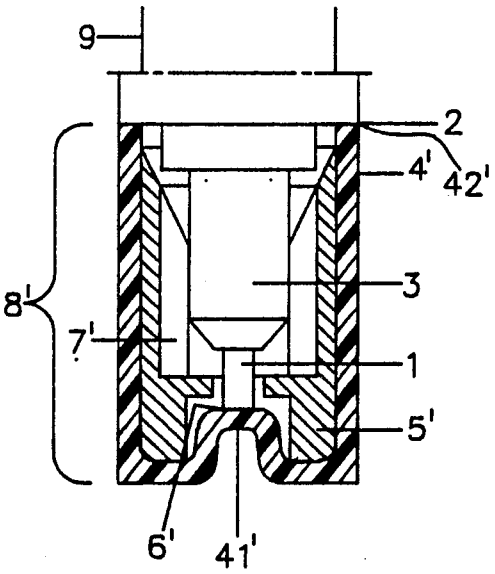
FIG. 7 is a sectional side view of a cap constructed in accordance with the invention and shows a completely inserted writing instrument.
Figure 6:
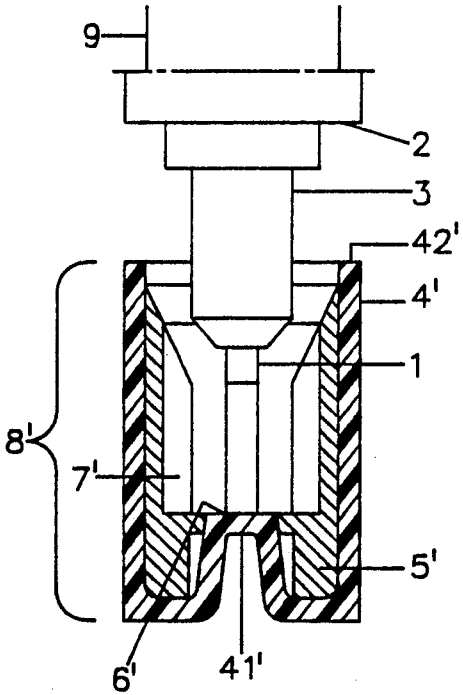
FIG. 6 is a sectional side view of a cap constructed in accordance with the invention and shows a partially inserted writing instrument.
Figure 5:
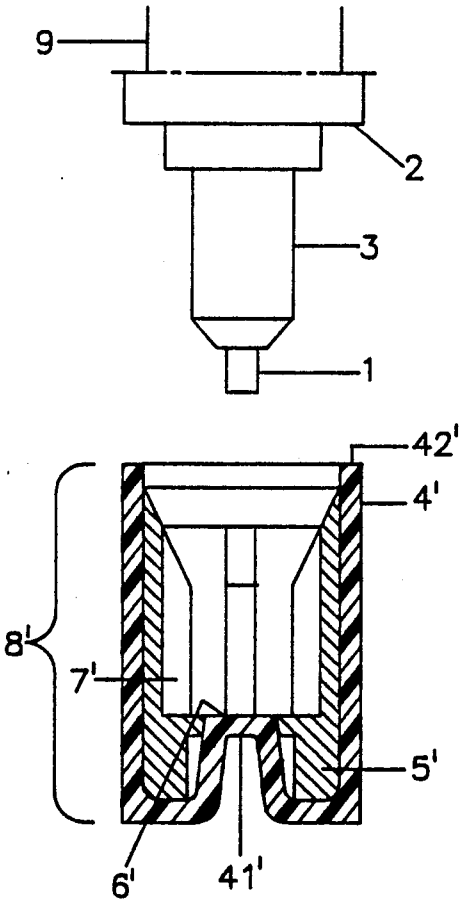
FIG. 5 is a sectional side view of a cap constructed in accordance with the invention and a side view of a writing instrument.

FIG. 5 shows writing instrument 9, pen tip 1, air compensation sealing surface 2, capillary sleeve 3, cap 8', resilient outer casing 4', inner casing 5', resilient sealing surface 6', outer casing closed end 41', outer casing leading edge 42', and securing means 7'. In this embodiment the resilient sealing means 6 is eliminated and a resilient sealing surface 6' for sealing tip 1 is provided by resilient outer casing 4'. The resilient sealing means is a portion 6' of resilient outer casing 4' that protrudes into the longitudinal aperture of inner casing 5'. FIG. 6 shows a pen 9 partially inserted into cap 8'. FIG. 7 shows a pen 9 completely inserted into cap 8'. When pen tip 1 comes in contact with the resilient sealing surface 6' of resilient outer casing 4', resilient sealing surface 6' deforms so as to prevent damage to tip 1 while forming a substantially fluid tight seal on tip 1. Resilient outer casing 4' may also deform to facilitate the sealing of and the protection of the tip 1. FIG. 8 shows resilient outer casing 4', inner casing 5', and securing means 7'.

Figure 12:
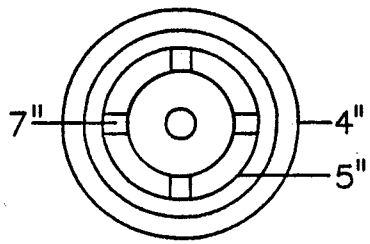
FIG. 12 is an end view of the open end of a cap constructed in accordance with the invention.
Figure 11:
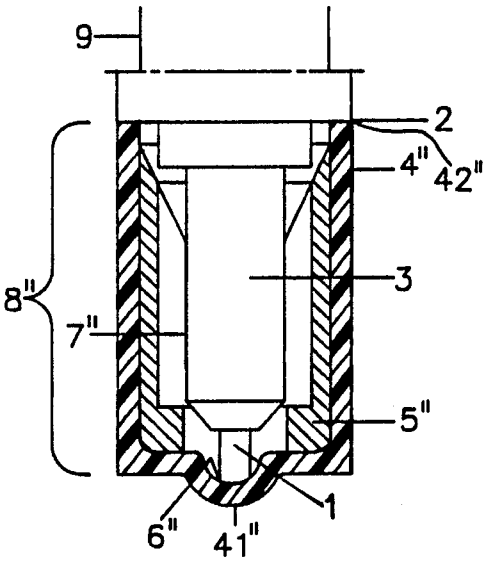
FIG. 11 is a sectional side view of a cap constructed in accordance with the invention and shows a completely inserted writing instrument.
Figure 10:
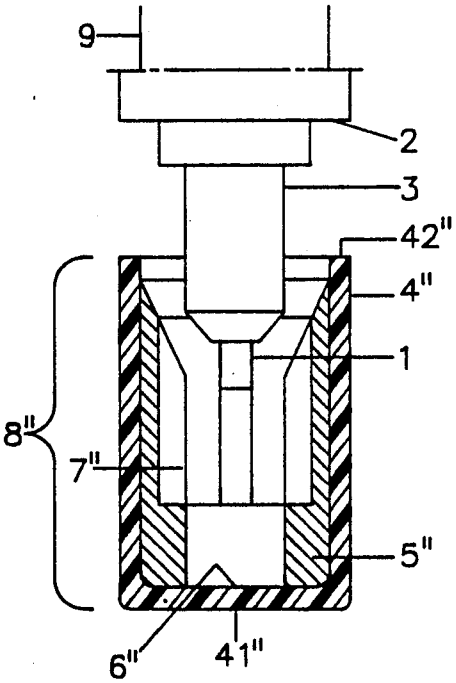
FIG. 10 is a sectional side view of a cap constructed in accordance with the invention and shows a partially inserted writing instrument.
Figure 9:
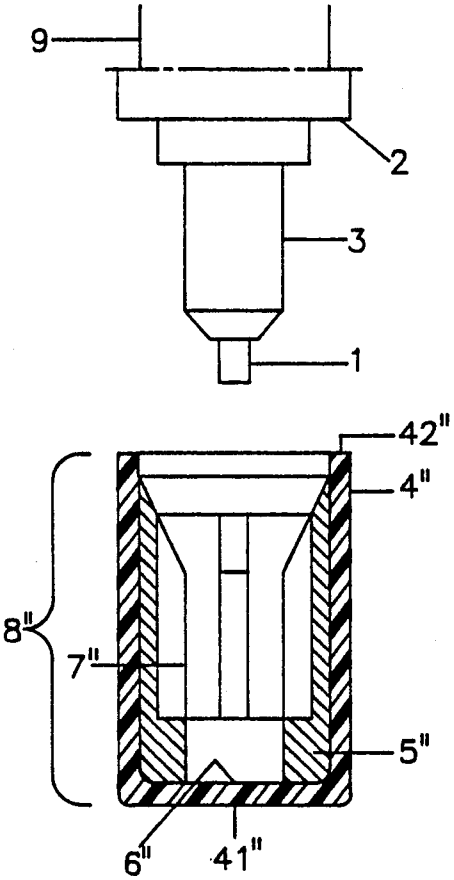
FIG. 9 is a sectional side view of a cap constructed in accordance with the invention and a side view of a writing instrument.

FIG. 9 shows writing instrument 9, pen tip 1, air compensation sealing surface 2, capillary sleeve 3, cap 8", resilient outer casing 4", inner casing 5", resilient sealing surface 6", outer casing closed end 41", outer casing leading edge 42", and securing means 7". In this embodiment the resilient outer casing 4" does not protrude into the longitudinal opening of inner casing 5". FIG. 10 shows writing instrument 9 partially inserted into cap 8". FIG. 11 shows the writing instrument 9 completely inserted into cap 8". When tip 1 comes into contact with the sealing surface portion 6" of resilient outer casing 4", resilient outer casing 4" is deformed in a direction away from pen tip 1, thus, providing a substantially fluid tight seal on tip 1 while preventing damage to tip 1. FIG. 12 shows resilient outer casing 4", inner casing 5", and securing means 7".

What is claimed is:

1. A cap for a writing instrument, comprising:

(a) a resilient outer casing provided with a longitudinal aperture, a closed end, and an open end, said closed end adapted to receive a sealing means, said open end adapted to form a substantially fluid tight seal around the body of a writing instrument;

(b) an inner casing inserted into said longitudinal aperture of said outer casing, said inner casing having a longitudinal aperture, an open first end, and an open second end, said second end adapted to retain a sealing means between said second end of said inner casing and said closed end of said outer casing;

(c) a resilient sealing means for forming a substantially fluid tight seal on a writing instrument tip, said sealing means located between said tubular inner casing and said resilient tubular outer casing; and (d) a securing means attached to the inner wall of said tubular inner casing for securing the cap to the writing instrument.

2. The cap of claim 1 wherein said sealing means is spherical.

3. A cap for a writing instrument comprising;

(a) a resilient outer casing provided with a longitudinal aperture, a closed end, and an open end, said open end adapted to form a substantially fluid tight seal around the body of a writing instrument, said closed end adapted to form a substantially fluid tight seal on a writing instrument tip;

(b) an inner casing provided with a longitudinal aperture and an open first end and an open second end, said inner casing inserted into the longitudinal aperture of said resilient tubular outer casing, said longitudinal aperture of said inner casing in communication with said seal;

(c) a securing means attached to the inner wall of said inner casing for securing the cap to the writing instrument.

4. The cap of claims 1, 2, or 3 wherein said outer casing has a hardness of about 37 to about 60 shore A and said inner casing has a hardness greater than about 70 shore B.

* * * * *